US008311652B2

(12) United States Patent
Taha et al.

(10) Patent No.: US 8,311,652 B2
(45) Date of Patent: Nov. 13, 2012

(54) CONTROL METHOD OF REFRIGERATION SYSTEMS IN GAS PLANTS WITH PARALLEL TRAINS

(75) Inventors: Othman A. Taha, Dhahran (SA); Henry H. Chan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1206 days.

(21) Appl. No.: 12/058,302

(22) Filed: Mar. 28, 2008

(65) Prior Publication Data

US 2009/0248174 A1 Oct. 1, 2009

(51) Int. Cl.
*G05B 13/02* (2006.01)

(52) U.S. Cl. ..... 700/28; 700/273

(58) Field of Classification Search ..... 700/28, 700/29, 30, 266, 272, 273
See application file for complete search history.

(56) References Cited

U.S. PATENT DOCUMENTS 5,611,216 A 3/1997 Low et al.
2006/0150672 A1 * 7/2006 Lee et al. ..... 62/623
2007/0245770 A1 10/2007 Taha et al.

* cited by examiner

*Primary Examiner* — Kakali Chaki
*Assistant Examiner* — Carlos Ortiz Rodriguez
(74) *Attorney, Agent, or Firm* — Bracewell & Giuliani, LLP

(57) ABSTRACT

An optimization method based on statistical modeling relating NGL plant process variables. The modeling may rely on input data from process history and modeled data. The method identifies process scenarios when a compressor from an associated propane/propylene refrigeration system may be deactivated and still allow the NGL plant to achieve product specification.

20 Claims, 4 Drawing Sheets

CONTROL METHOD OF REFRIGERATION SYSTEMS IN GAS PLANTS WITH PARALLEL TRAINS

BACKGROUND OF THE INVENTION

1. Field of the Invention

This invention generally relates to the field of optimization of control variables to maximize production of Natural Gas Liquids ("NGL") in a gas plant while minimizing the refrigeration system power usage, including systems in multiple processing trains.

2. Description of the Related Art

Gas plants produce fuel gas, Natural Gas Liquids ("NGL") and other solid components such as sulfur. Such plants typically include distillation columns, heat exchangers, and refrigeration systems. The NGL product must meet certain specifications in order to be a saleable product, but variation within these boundaries is acceptable. Early efforts to improve NGL quality have been directed toward maximizing the amount of refrigeration used to achieve better recovery of heavier components. As energy costs have increased, this approach is no longer economical.

Other efforts have focused on design of turbo-expanders that drive recompression with the objective of maximizing NGL production. Other methods teach of physically manipulating the temperature profile within the column to obtain desired separation results or pressure responsive fractionation control system. With the increasing cost of energy, these approaches may not provide the most cost-effective approach.

It would be advantageous to develop a new method and apparatus that provides improvement in the recovery of the valuable NGL products while minimizing energy requirements, including systems in multiple processing trains. It would be advantageous to allow for the optimization of the process variables within allowable quality variations and equipment constraints while minimizing the overall electricity or energy usage.

SUMMARY OF THE INVENTION

Disclosed herein is a method of optimizing a Natural Gas Liquids ("NGL") facility, wherein the NGL facility comprises NGL trains each having an NGL process. The NGL trains may comprise two or more trains in parallel. The method comprises establishing a baseline NGL recovery for each NGL process and modeling a process scenario for each NGL process using input variables. The input variables comprise process data and wherein each NGL process comprises first and second refrigeration circuit with associated refrigeration compressors. The method further includes modeling a simulated selective deactivation of a refrigeration compressor, determining a modeled NGL recovery for each NGL process from the aforementioned simulation step, and classifying the process scenario as a compressor off scenario if the modeled NGL recovery is substantially at least the same as the baseline NGL recovery. Using the data from the simulation, the method further comprises operating a functioning NGL facility having a process scenario wherein the functioning NGL facility comprises a first and second refrigeration system with associated refrigeration compressors, deactivating a refrigeration system compressor of the functioning NGL facility if the process scenario is classified as a compressor off scenario, and optimizing a feed flow rate distribution to each NGL train. In one embodiment the first and second refrigeration systems comprise C3 refrigeration systems having C3 compressors. In another embodiment the first and second refrigeration systems comprise refrigeration systems where the working fluid is one of ethane, ethylene, propane, or mixtures thereof. In another embodiment, the NGL process comprises a third refrigeration process. The third refrigeration process working fluid may be one of ethane, ethylene, propane, propylene, or combinations thereof.

Also disclosed herein is an NGL facility having first and second propane refrigeration systems and an ethylene refrigeration system. The facility includes a controller for operating the facility, wherein the controller accesses statistical process data and is configured to selectively deactivate one or more compressors of the propane refrigeration systems if the baseline NGL product specifications are attainable without operation of the compressor. The aforementioned method is also applicable to other facilities, including gas processing plants, liquefied natural gas facilities, turbo-expander plants, food processing plants, and any processing facility using two or more parallel trains.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION

Disclosed herein is a method for optimizing the production of an NGL product stream from one or more NGL trains. The method for optimizing utilizes the available refrigeration capacity provided from refrigeration circuits associated with each train. The method honors process equipment and product quality constraints such as the NGL product specification, an upper limit of the percents of ethane, methane, and lighter components (mole percent) in the residue gases, a maximum pressure drop across the demethanizer column and a predetermined operating range for suction pressures of the associated refrigerant compressors.

Figure 1:
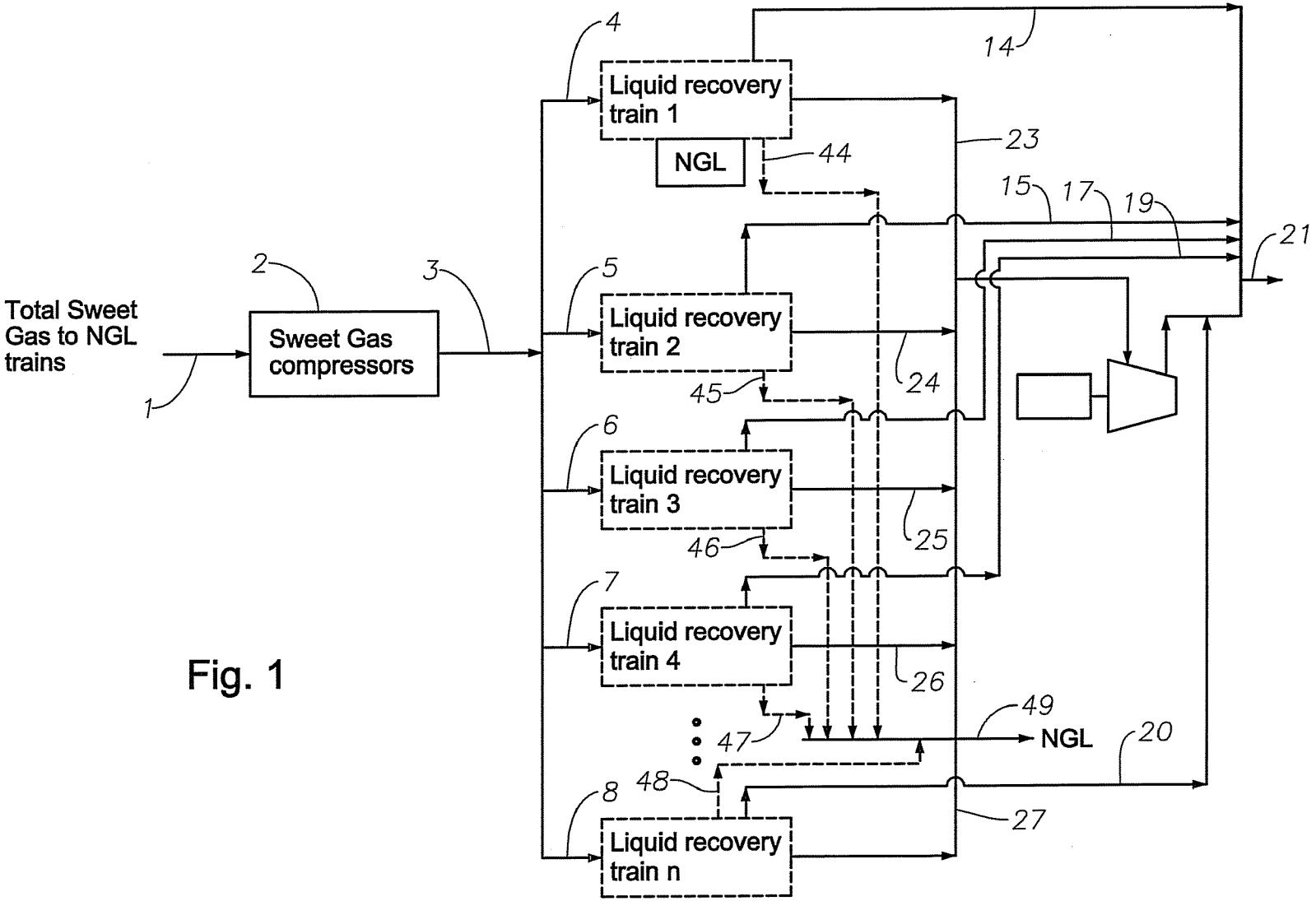
FIG. 1 is a schematic view of an NGL facility having multiple parallel trains.

FIG. 1 provides a schematic overview of an NGL facility, where the facility has multiple NGL trains in parallel. In this embodiment a sweet gas feed 1 is directed to sweet gas compressor 2 thereby creating a compressed feed gas stream 3. The compressed feed gas stream 3 is delivered, via a header manifold system; to the individual liquid recovery trains. Feed lines (4, 5, 6, 7, 8) respectively provide connectivity from the compressed feed stream 3 to individual liquid recovery trains 1-n. As will be discussed in more detail below, an example of a liquid recovery train is provided in FIG. 2. With reference again now to FIG. 1, high pressure gas from each of the recovery trains is directed by high pressure gas lines (14, 15, 17, 19, 20) from liquid recovery trains 1-n. The NGL product line 49 from the NGL facility is fed from individual NGL lines (44, 45, 46, 47, and 48) from the liquid recovery trains. Also shown is the HP (high pressure) line 21 receiving high pressure gas from lines 23, 24, 25, 26, and 27 from the individual liquid recovery trains 1-n.

Figure 2:
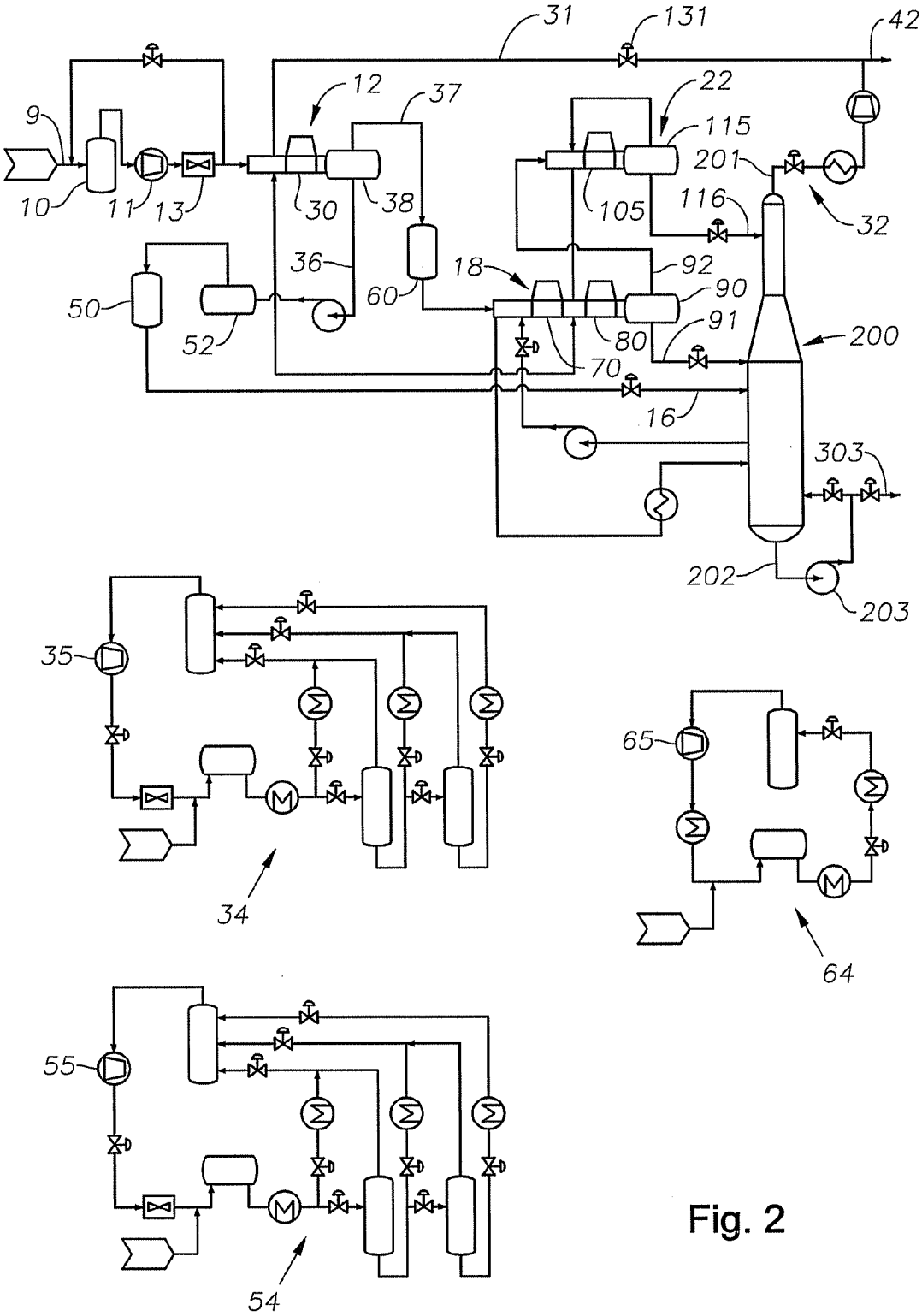
FIG. 2 is a schematic representation of an NGL train with associated refrigeration circuits.

An example of an NGL train for use with the present method is shown in the schematic of FIG. 2. This embodiment comprises a natural gas feed stream 9 that is fed to a knock out drum 10 prior to delivery to a sweet gas compressor 11. After being compressed, the stream is cooled with a heat exchanger 13 upstream of a first chilling unit 12 to produce chilled rich gas stream 37 and chilled liquid stream 36. Pressure and flow monitoring devices are useful for determining or controlling the pressure and flow of the feed stream 9. Residue gas stream 31, in combination with other residue from a demethanizer 200 is collectable as sales gas. The demethanizer 200 is a column with trays wherein NGL product exits from its overhead and bottoms. Pressure of stream 31 is measured and monitored and the unit pressure may be controlled with the valve 131. Flow of stream 31 is measured, typically after valve 131.

Chilled rich gas stream 37 and chilled liquid stream 36 have different compositions as a result of separation of natural gas feed stream 9. Natural gas feed stream 9 contains sweet gas that has been submitted to a sweetening process to remove hydrogen sulfide and carbon dioxide. Natural gas stream 9 is dehydrated in molecular sieve beds to reduce moisture levels. Natural gas feed stream 9 is preferably in a pressure range of 200-1000 psig or is compressed to reach this range. Chilled gas stream 37 is fed through drum 60 to second chilling unit 18 to produce second chilled gas stream 92 and second chilled liquid stream 91. The second chilled gas stream 92 is fed to the third chilling unit 22 to produce third chilled liquid stream 116.

Bottom stream 202 can be split to provide NGL outlet stream 303. When alternate heat sources are available to the bottom of the demethanizer and/or a stream containing at least partial vapor is fed to the bottom of the demethanizer, then the entire bottom stream 202 can be removed as NGL product. The three liquid streams provide feed stream for the demethanizer column from which the NGL product is drawn from the bottom.

Shown in FIG. 2, the three liquid streams, namely, chilled liquid stream 16, second chilled liquid stream 91 and third chilled liquid stream 116, are fed to the demethanizer column 200. The chilled liquid stream 36 is pumped through optional drums (52, 50) and chilled liquid stream 16 denotes the stream from the exit of the drum 50 to the demethanizer 200. Liquid product from the bottom of the column 200 exits as a bottoms stream 202. Bottoms stream 202 may be characterized by a bottom ratio defined by methane concentration of the bottom stream divided by ethane concentration of the bottom stream and is controlled to a specified bottoms product specification. A pump 203 may be employed to pump the bottoms stream 202 to the NGL product 303 or recirculation back to the demethanizer column 200.

Vapor from the top tray of the demethanizer column 200 exits the column 200 as an overhead stream 201. The overhead stream 201 is characterized by an overhead ethane and propane concentration. An overhead valve 32 on the overhead stream 201 may be used for controlling pressure in the column 200.

Overhead stream 201 is shown being compressed to become residue gas stream 42, which comprises a sales gas stream. In another embodiment (not shown), the overhead stream 201 can be split, with compression before or after the split, to produce the residue gas stream and a recycle stream that is recycled into the demethanizer or other unit. In an alternate embodiment, the overhead stream of the column is low pressure residue gas, which can be combined with the high pressure residue gas to produce a sales gas.

A first refrigeration system 34 provides cooling to first chiller 30, second chiller 70, and third chiller 80. The first chilling unit 12 includes first chiller 30 and first chill down separator 38. The second chilling unit 18 includes second chiller 70, third chiller 80, and separator 90. The third chilling unit 22 includes fourth chiller 105 and separator 115. The fourth chiller is refrigerated by third refrigeration system 64. In one embodiment, the second chill down separator 90 defines a second chill down separator temperature, and the subsequent second chiller 80 defines a subsequent second chiller output level. Level instruments may be installed in second chiller 70 and subsequent second chiller 80.

An embodiment of the first refrigeration system 34 is shown in a schematic view in FIG. 2. The first refrigeration system 34 is a closed system circulating a refrigeration fluid therethrough. In one embodiment the first refrigeration system 34 uses a C3 fluid as a working fluid, where the C3 fluid includes any three carbon based fluid, such as propane, propylene, propyne, or combinations thereof. The first refrigeration system 34 provides refrigeration to the NGL facility by using the compressor 35 to compress the working fluid in vapor form into high pressure gas, condensing the high pressure gas into a liquid, then vaporizing the liquid across control valves for heat absorption by the vaporizing refrigeration working fluid. The vaporizing fluid is directed through heat exchangers for chilling desired streams of the NGL facility.

Shown in schematic view in FIG. 2, the second refrigeration system 54 is operated to provide cooling to some of the same equipment as system 34 and operates largely the same as the first refrigeration system 34. Moreover, in one embodiment the second refrigeration system 54 also uses a C3 fluid as its working fluid. The second refrigeration system 54 can be implemented in parallel with first refrigeration system 34 that can be operated independently, or it can be used as a backup system when the first refrigeration system 34 is out of service. Second refrigeration system 54 includes a second refrigeration compressor 55. The first and/or second refrigeration systems (34, 54) may, in an embodiment, be referred to as a C3 refrigeration system(s).

One embodiment of an third refrigeration system 64 is provided in schematic view in FIG. 2. The third refrigeration system 64, like the first and second refrigeration systems (34, 54) is a closed system providing chilling to selected streams in the NGL process facility. In one embodiment the third refrigeration system 64 provides heat exchange to fourth chiller 105. The third refrigeration system 64 includes a third refrigeration compressor 65 for compressing the refrigeration system 64 gas into high pressure gas. The working fluid circulating in the third refrigeration system 64 may be a C2 fluid comprising ethane, ethylene, acetylene, or mixtures thereof. The third refrigeration system 64 may, in one embodiment, be referred to as a C2 refrigeration system.

The present method involves an optimization of an operation of an NGL facility by minimizing the refrigeration load. The optimization disclosed herein maintains the NGL product specification without venturing outside of a prescribed ethane and propane concentration range of the demethanizer overhead 201. The refrigeration load comprises energy requirements (such as the electricity required) to operate the associated refrigeration systems. In one embodiment of the present method, the associated refrigeration systems include the first refrigeration system 34, the second refrigeration system 54, and the third refrigeration system 64.

One optimization method disclosed is based on statistical modeling relating NGL facility or plant process variables with the refrigeration system's electricity usage. The method identifies process control variables in an NGL facility for optimization and is useful for NGL facilities having single or multiple NGL trains. Key optimal targets may be included with the present method for the process control settings. These key optimal targets can be fed to a multivariable controller algorithm (such as model-based predictive control (MPC)) that controls the NGL plants, or can be implemented directly by the NGL plant operators inputting the calculated optimal targets in the NGL plant's distributed control system (DCS). Mixed Integer optimizers provide a method for determining an optimal number of deactivated refrigeration compressors in the "compressor off" scenario or in the partial recycle modes. Examples of other optimization techniques applicable with the disclosed method include "AMS Optimizer" available from Emerson Process Management, Profit Max, available from Honeywell, Inc, and ROMEO, available from Invensys Inc. In one optional embodiment, an "equipment performance monitor" is included for monitoring and ensuring the proper functioning of the refrigeration compressors. An example of an "equipment performance monitor" is Matrikon Inc.'s "Equipment Condition Monitor", another is Emerson Process Management's AMS Suite.

Model Predictive Control ("MPC"), is an advanced control method for process industries that improves on standard feedback control by predicting how a process, such as distillation, will react to inputs such as heat input. This means that reliance on feedback can be reduced since the effects of inputs will be derived from mathematical empirical models. Feedback can still used to correct for model inaccuracies. The MPC controller relies on an empirical model of a process obtained, for example, by plant testing to predict the future behavior of dependent variables of a dynamic system based on past moves of independent variables. MPC usually relies on linear models of the process. Commercial suppliers of MPC software useful in this invention include AspenTech (DMC+), Honeywell (RMPCT) and Shell Global Solutions (SMOC).

The current method is also applicable to an NGL plant with a single refrigeration system by using the same empirical optimization method based on statistical modeling relating NGL plant process variables with the refrigeration system's electricity usage. The method identifies the key process control variables in an NGL plant to be optimized. One example of a statistical optimization method can be found in Taha et al., Ser. No. 11/797,803, published on Oct. 25, 2007 with publication number 2007/0245770 and assigned to Saudi Arabian Oil Company, which is the assignee of the present application, the entirety of which is incorporated for reference herein.

Figure 3:
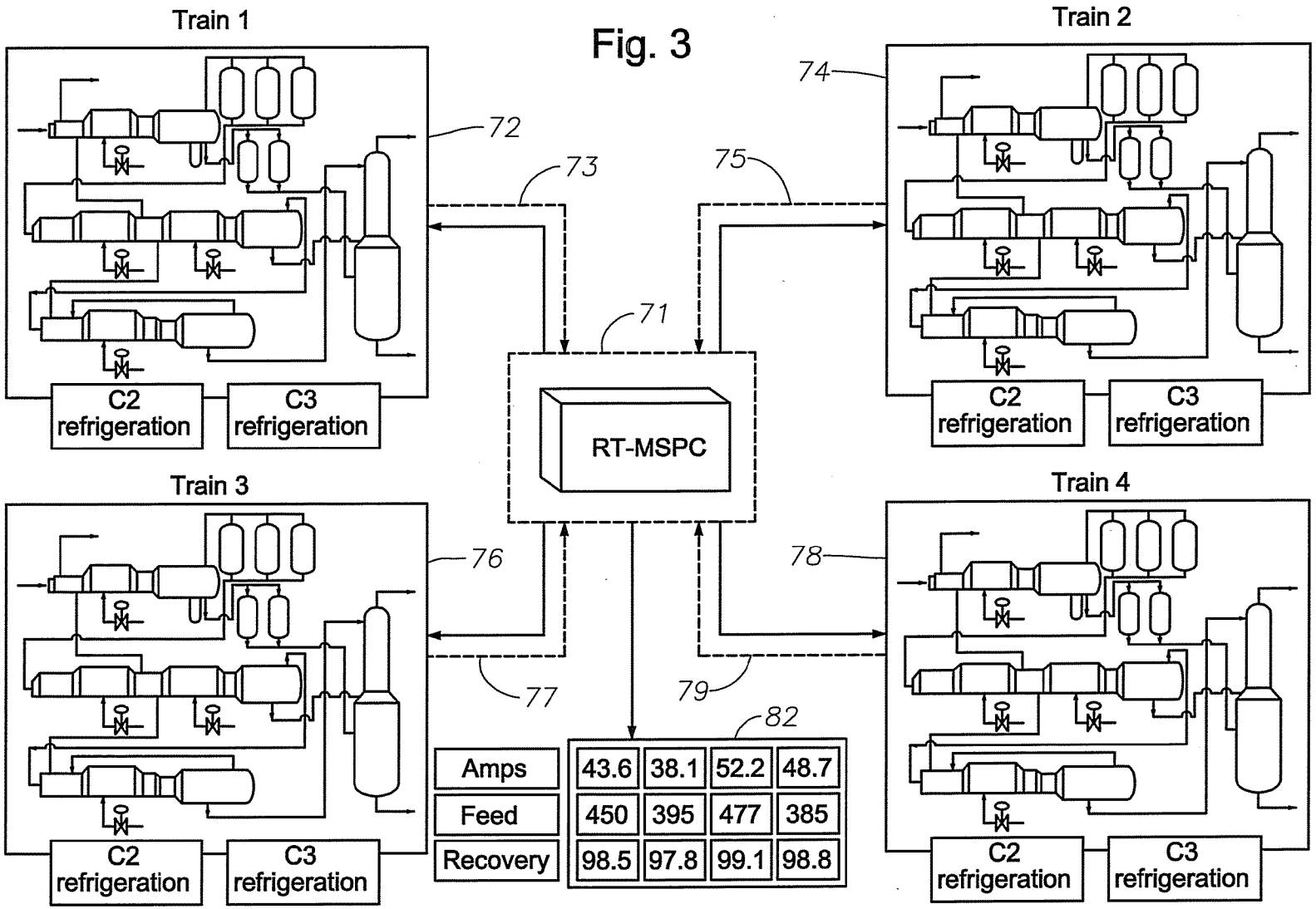
FIG. 3 illustrates a schematic view of NGL trains in communication with an optimizing controller.

An apparatus corresponding to an embodiment of the method disclosed herein is represented in FIG. 3. In FIG. 3, four trains (72, 74, 76, 78) are illustrated in communication with a controller 71 through communication links (73, 75, 77, 79). In the embodiment of FIG. 3, the controller 71 is a single unit that communicates with each of the trains via a respective communication link. Optionally, each specific train could include a dedicated controller that provides control commands to portions of each NGL process train for operating those trains. An optional output 82 is provided that provides a readout of the compressor electricity usage in amperes, the flow rate to each of the individual trains and the percent NGL recovery.

In one mode of operation, the present method comprises compiling data during operation of an NGL process facility. Data may also optionally be obtained from modeling operating of the facility. Using the acquired data (actual, modeled, or both) a statistical optimization analysis is performed and an optimized NGL recovery is calculated. The estimation is performed on different process scenarios with one or more differing input values. Input values such as total feed to the NGL facility, ambient temperatures, and feed composition may be varied during the statistical analysis. Values not varied during the analysis include the NGL product specifications, the ethane (C2) and propane (C3) mole percent upper limits in the residue gas, the maximum pressure drop across the top section of the associated demethanizer, and a predetermined operating range for refrigerant compressor suction pressure.

The present optimization method includes modeling a process scenario by simulating selective deactivation of one or more refrigeration compressor(s) and evaluating the corresponding modeled NGL product; where the product includes the NGL product stream 303, the gas stream 42, or a combination. If the modeled NGL product has specifications within a predetermined acceptable or baseline product range, the process scenario is a "compressor off" scenario. Similarly, process scenarios are classified as a "compressor on" scenario if simulated deactivation of a refrigeration compressor results in a modeled NGL product whose specifications fall outside of a predetermined acceptable product range. Accordingly, by performing the statistical analysis disclosed herein, operating process scenarios can be identified where at least one refrigeration compressor can be deactivated without reducing NGL recovery. Deactivating a refrigeration compressor reduces compressor load, which in turn reduces the overall cost of operating the NGL process facility without compromising NGL product quality. In operation, either an automated controller or manual operator identify an actual process scenario, determine if the actual process scenario is a compressor off scenario, and deactivate one or more of the refrigeration compressors. The optimization method herein described is also useful for NGL facilities having multiple trains. In multiple train facilities the optimization method redirects a portion of the flow from the train(s) with a deactivated compressor and distributes the redirected portion to other trains.

In one example, an NGL facility optimized having four natural gas trains with a total of 8 propane compressors. Each of the propane compressors has a power of 40,000 horse power each. In this scenario, each of the trains typically has a feed of no more than 420 MMSCD. Applying the aforementioned optimization and modeling methods it has been determined one of the C3 compressors may be shut down without a loss of recovery if the total feed to the NGL facility is less than 1,470 MMSCD (1,470 MMSCD=3×420 MMSCD+(½)×420 MMSCD). Thus, the NGL train having a deactivated compressor receives a proportionally reduced amount of feed. Similarly, if the total feed is less than 1,260 MMSCD (1,260 MMSCD=3×420 MMSCD), the facility can operate with maximum NGL recovery with only six compressors activated or otherwise operating.

Figure 4:
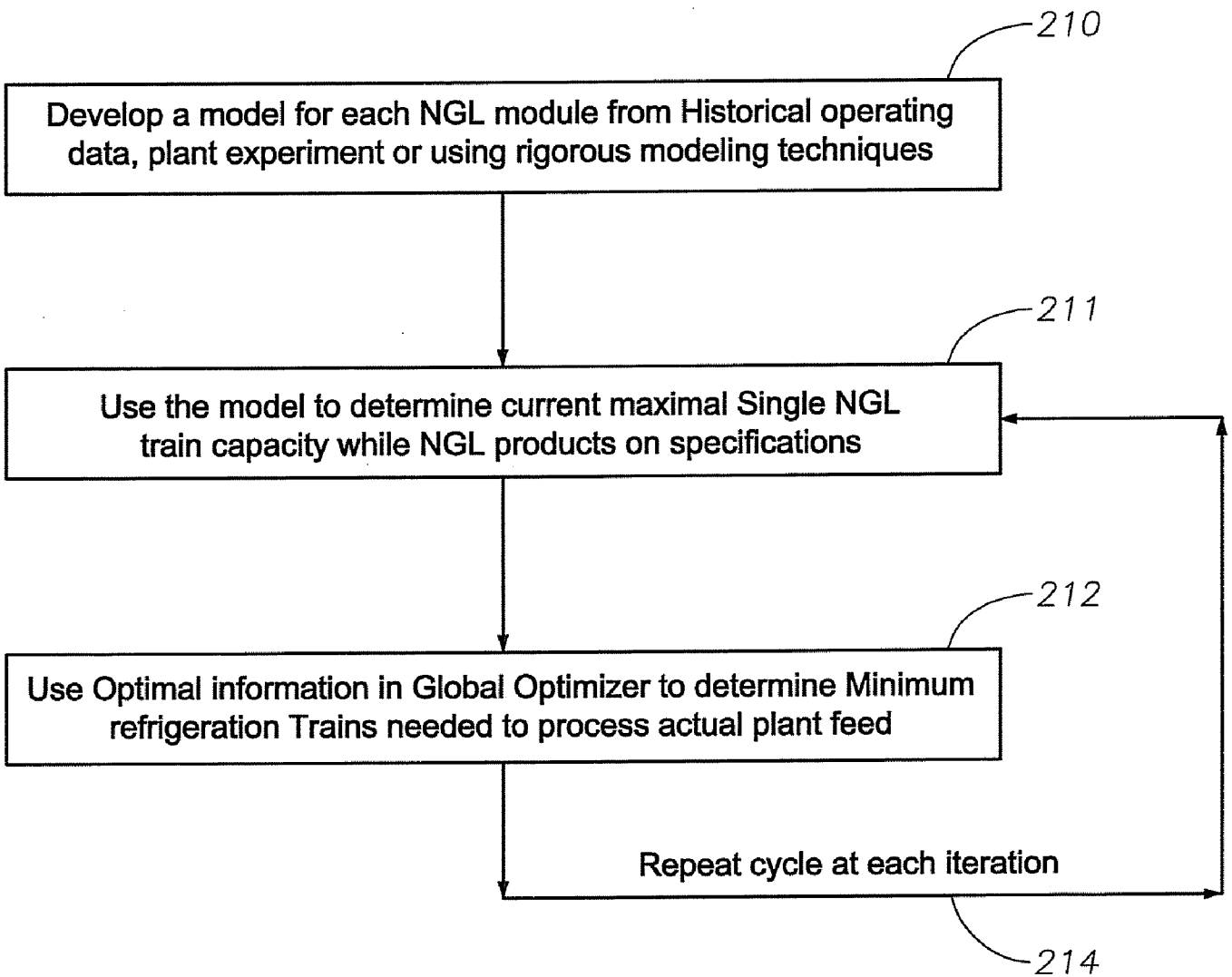
FIG. 4 portrays a flow chart illustrating an embodiment of a method of an optimization scheme for a process train.

FIG. 4 portrays a flow chart illustrating an embodiment of an optimization method for an NGL plant. This method includes developing a model for a specific NGL train or module based on historical operating data, plant experimentation, modeling, and combinations of these (step 210). The experimentation may be done at a pilot plant or a laboratory. The modeling may include a "rigorous modeling technique". The model may be used to calculate the maximum capacity of a single NGL train, with the constraint that the NGL product remains within specification (step 211). The minimum number of refrigeration trains needed to process actual plant feed can then be determined using optimal information in a global optimizer (step 212). The optimization method can include multiple iterations (step 214), where steps 211 and 212 are repeated at each iteration.

While the invention has been shown or described in only some of its forms, it should be apparent to those skilled in the art that it is not so limited, but is susceptible to various changes without departing from the scope of the invention. For example, this invention may be used in process design but is also useful in conjunction with an existing process plant. This invention is useful as a steady state tool and also for real time optimization. For example, splitters can be added to redirect amounts of flow or to allow for control of amounts of flow. Recycle streams can be used to enhance recovery or as a heat since for heat exchangers. Other variation can also be made.

What is claimed is:

1. A method of optimizing a natural gas liquids (NGL) facility, wherein the NGL facility comprises NGL trains each having an NGL process, the method comprising:

(a) establishing a baseline NGL recovery for each NGL process;

(b) modeling a process scenario for each NGL process using input variables, wherein the input variables comprise process data and wherein each NGL process comprises first and second refrigeration circuits with associated refrigeration compressors;

(c) modeling a simulated selective deactivation of a refrigeration compressor;

(d) determining a modeled NGL recovery for each NGL process from step (c);

(e) classifying the process scenario as a compressor off scenario if the modeled NGL recovery is substantially at least the same as the baseline NGL recovery;

(f) operating a functioning NGL facility having a process scenario based on step (b) wherein the functioning NGL facility comprises a first and second refrigeration circuits with associated refrigeration compressors;

(g) deactivating a refrigeration compressor of the functioning NGL facility if the process scenario is classified as a compressor off scenario; and (h) optimizing a feed flow rate distribution to each NGL train.

2. The method of claim 1, further comprising classifying the process scenario as a compressor on scenario if the modeled NGL recovery is less than the baseline NGL recovery.

3. The method of claim 1 further comprising repeating steps (b) through (g) using a different process scenario.

4. The method of claim 1, wherein the step of modeling a process scenario comprises statistical optimization.

5. The method of claim 1 wherein the process data comprises values selected from the group consisting of measured NGL process data and modeled NGL process data.

6. The method of claim 1 wherein the input variables comprise values selected from the group consisting of feed flow rate to an NGL process, feed flow composition to an NGL process, NGL process pressure, NGL process temperature, and NGL process heat exchanger duty.

7. The method of claim 1, wherein the NGL facility comprises four NGL trains.

8. The method of claim 7, wherein the NGL trains are arranged in parallel.

9. The method of claim 1, wherein the NGL process further comprises a C2 refrigeration circuit having a C2 refrigeration compressor.

10. The method of claim 1, wherein the baseline NGL recovery comprises values selected from a group consisting of NGL overhead recovery from an NGL fractionation column, bottoms recovery from the NGL fractionation column, C3 recovery from an NGL fractionation column, bottoms C3 recovery from the NGL fractionation column, and combinations thereof.

11. The method of claim 1, wherein the first and second refrigeration circuits comprise C3 refrigeration circuits.

12. A method of optimizing the operation of a natural gas liquids (NGL) facility wherein the NGL facility comprises first, second, and third chilling units, a demethanizer column, first and second propane refrigeration systems having propane refrigeration compressors, and an ethane refrigeration system, the method of optimizing comprising:

(a) modeling process scenarios for the NGL facility comprising, simulating selective deactivation of one of the propane refrigeration compressors, determining a modeled NGL recovery value, identifying the modeled process scenario as a compressor off scenario if the modeled NGL recovery value is approximately at least the value of a predetermined NGL recovery specification value for a modeled process scenario where one of the refrigeration compressors is selectively deactivated;

(b) feeding a natural gas feed stream to the first chilling unit to produce a chilled rich gas stream and a chilled liquid stream;

(c) feeding the chilled rich gas stream to the second chilling unit to produce a second chilled rich gas stream and a second chilled liquid stream;

(d) feeding the second chilled rich gas stream to the third chilling unit to produce a third chilled liquid stream;

(e) feeding the chilled liquid stream and the second chilled liquid stream and the third chilled liquid stream to the demethanizer column, the demethanizer column producing an overhead stream and a bottoms stream, the bottoms stream having a bottom product specification, the overhead stream defining an overhead propane concentration;

(f) feeding the overhead stream through an overhead valve having an overhead valve outlet pressure;

(g) providing heat exchange through the first propane refrigeration system to the first chilling unit, the first chilling unit having a first chiller, the first chilling unit having a first chill down separator;

(h) providing heat exchange through the second propane refrigeration system operable for providing cooling to the second chilling unit, the second chilling unit having a second chill down separator, the second chilling unit including a primary second chiller;

(i) providing heat exchange to the third chilling unit through the ethane refrigeration system having an ethane compressor; and (j) deactivating a propane refrigeration compressor if the process of the NGL facility is similar to a modeled process scenario identified as a compressor off scenario.

13. The method of claim 12 wherein the process scenario comprises input variables comprising values selected from the group consisting of feed flow rate to an NGL process, feed flow composition to an NGL process, NGL process temperature, NGL process temperature, and NGL process heat exchanger duty.

14. The method of claim 12, further comprising classifying the process scenario as a compressor on scenario if the modeled NGL recovery value is less than the predetermined NGL recovery specification value.

15. The method of claim 12 wherein the process scenarios of step (a) have different input variables.

16. The method of claim 15 wherein the input variables comprise values selected from the group consisting of feed flow rate to an NGL process, feed flow composition to an NGL process, NGL process temperature, NGL process temperature, and NGL process heat exchanger duty.

17. The method of claim 15, wherein the step of modeling comprises statistical optimization.

18. The method of claim 12, wherein the NGL facility comprises four NGL trains.

19. The method of claim 18, further comprising optimizing flow distribution to the NGL trains.

20. The method of claim 12, wherein the predetermined NGL recovery specification value comprises values selected from a group consisting of NGL overhead recovery from an NGL fractionation column, bottoms recovery from the NGL fractionation column, NGL overhead C3 recovery from an NGL fractionation column, bottoms C3 recovery from the NGL fractionation column, and combinations thereof.

* * * * *